US007096699B2

(12) United States Patent
Bryan

(10) Patent No.: US 7,096,699 B2
(45) Date of Patent: Aug. 29, 2006

(54) MULTIPLE BLADDER INTERNAL TUBE EXPANSION AND METHOD

(75) Inventor: Troy Davis Bryan, Cibolo, TX (US)

(73) Assignee: York International Corp., York, PA (US)

( * ) Notice: Subject to any disclaimer, the term of this patent is extended or adjusted under 35 U.S.C. 154(b) by 242 days.

(21) Appl. No.: 10/776,428

(22) Filed: Feb. 11, 2004

(65) Prior Publication Data

US 2004/0226332 A1 Nov. 18, 2004

Related U.S. Application Data

(60) Provisional application No. 60/447,576, filed on Feb. 13, 2003.

(51) Int. Cl.
*B21D 39/20* (2006.01)

(52) U.S. Cl. ..... 72/54; 72/370.08; 72/370.22

(58) Field of Classification Search ..... 72/61, 72/62, 58, 370.08, 370.22, 466.7, 466.8, 72/54; 29/890.044
See application file for complete search history.

(56) References Cited

U.S. PATENT DOCUMENTS

| | | | | |
|---|---|---|---|---|
| 3,820,828 | A | 6/1974 | Fiddler | |
| 3,823,605 | A | 7/1974 | Schmitz et al. | |
| 4,055,063 | A | 10/1977 | Krips et al. | |
| 4,188,577 | A | 2/1980 | Mhatre et al. | |
| 4,192,194 | A | 3/1980 | Holt | |
| 4,353,257 | A | 10/1982 | Vrba et al. | |
| 4,468,952 | A | 9/1984 | Rathburn | |
| 4,498,220 | A | 2/1985 | Fiegen et al. | |
| 4,513,497 | A * | 4/1985 | Finch | 29/727 |
| 4,633,177 | A | 12/1986 | David et al. | |
| 4,649,493 | A | 3/1987 | Castner et al. | |
| 4,668,912 | A | 5/1987 | Junker | |
| 4,889,679 | A * | 12/1989 | Snyder et al. | 376/258 |
| 4,992,735 | A | 2/1991 | Cullen et al. | |
| 5,025,215 | A | 6/1991 | Pirl | |
| 5,339,693 | A | 8/1994 | Rowlands et al. | |
| 5,377,530 | A | 1/1995 | Allen et al. | |
| 5,392,626 | A | 2/1995 | Blezard et al. | |
| 5,396,800 | A | 3/1995 | Drinon et al. | |
| 5,418,823 | A | 5/1995 | Kervinen et al. | |
| 5,438,862 | A | 8/1995 | Keating et al. | |

(Continued)

FOREIGN PATENT DOCUMENTS

| | | |
|---|---|---|
| DE | 482 191 C | 9/1929 |

(Continued)

*Primary Examiner*—Derris H. Banks
*Assistant Examiner*—Debra M Wolfe
(74) *Attorney, Agent, or Firm*—McNees Wallace & Nurick LLC

(57) ABSTRACT

Method and apparatus for the production of a plurality of uniform expansions of a tube in a plurality of tube supports simultaneously. A plurality of tubes are expanded in apertures of tube supports in a repetitive manner, each tube being expanded into the plurality of tube supports simultaneously. The tube expander assembly, when positioned such that each bladder is centered on each land of the tube support surrounding the tube, will precisely control the degree (magnitude) of expansion of each tube against the tube support aperture by controlling the amount of applied hydraulic pressure applied to expandable bladders. The method and apparatus can also be used to expand a tube into the apertures of the tube sheet. This operation can be accomplished without removing the tube expander assembly from the tube. Ideally, the operation is accomplished simultaneously, but may be accomplished in sequential pressurizations.

24 Claims, 6 Drawing Sheets

U.S. PATENT DOCUMENTS 5,462,077 A 10/1995 Cohen et al.
5,492,017 A 2/1996 Jennings et al.
5,606,792 A * 3/1997 Schafer ..... 29/727
5,752,317 A * 5/1998 Keating et al. ..... 29/890.044
5,791,046 A * 8/1998 Schafer ..... 29/890.031
5,907,965 A 6/1999 Krausser

FOREIGN PATENT DOCUMENTS

GB 863 630 A 11/1960

* cited by examiner

MULTIPLE BLADDER INTERNAL TUBE EXPANSION AND METHOD

CROSS-REFERENCE TO RELATED APPLICATIONS

This application claims the benefit of U.S. Provisional Application No. 60/447,576 filed Feb. 13, 2003.

FIELD OF THE INVENTION

The present invention is generally directed to method and apparatus for expanding a tube at a plurality of support locations, and specifically to expanding chiller tubes at a plurality of support saddle locations simultaneously.

BACKGROUND OF THE INVENTION

The present invention is used to expand tubing used in chillers. Chillers are a component of a refrigeration system typically being of a shell-and-tube design, the shell typically comprised of steel and the tubes being comprised, of copper or copper alloy. Chillers are used for large industrial process cooling and commercial air conditioning. The chiller comprises a plurality of tubes, from a few tubes to a few thousand tubes, depending upon the capacity of the refrigeration system, extending through the shell structure. The shell structure has a longitudinal axis and a head at either end of the shell structure. The heads typically act as manifolds for a fluid. The tubes extend through the shell structure generally parallel to the longitudinal axis of the shell structure. Within the shell structure, the tubes extend between tube sheets in the heads. The tube sheets include a plurality of apertures into which the tubes are inserted. The tubes are plastically deformed by expansion into the tube sheet structure to form an extremely tight joint to prevent a first fluid flowing through the tubes from leaking around the joint and behind the tube sheet and mixing with a second fluid flowing over the tube bundle. The tight joint also prevents the second fluid from leaking across the joint and mixing with the first fluid flowing in the tubes. Although very uncommon in chiller applications, if a 100% leak-proof seal is demanded, a weld can be placed at the joint between the tube and the tube sheet.

The shell structure of the chiller can be of varying lengths, and therefore contains tube supports for the plurality of tubes at one or more locations along the length between the tube sheets. The tube supports include a plurality of tube apertures into which the tubes are inserted to form a tube bundle. Tube supports are axially located along the tubes, providing them with support and the problem of leakage across the joint is not an issue unless the tube is cracked. Refrigerant fluid and water are the fluids typically used in these heat exchangers. One of these fluids flows through the tubes and exchanges heat with the other fluid flowing over the tubes. In some designs, water flows through the tubes and refrigerant flows over the tube bundle to accomplish heat exchange. In other designs, the refrigerant flows through the tubes and water flows over the tube bundle to accomplish heat exchange. For the purposes of this invention, the particular design is not important. However, it is important that in either design, the flow paths of the fluids remain independent so that mixing of the fluids is minimized or prevented. Depending upon the location of the chiller within the refrigeration cycle, the chiller may act as a condenser or as an evaporator. Again, the particular application is not important for this invention. It is important, however, that mixing of the two different fluids be minimized or prevented, while also providing support to the tubes in the chiller.

These tube supports provide mechanical support to the plurality of tubes and maintain their separation so they can be effective in providing heat transfer. During operation, to reduce any noise due to vibration of the tubes against the apertures in the tube support, it is necessary to secure the tube against the corresponding aperture in the tube support. This gap can also lead to damage to the tube during the life of the chiller. The damage can be the result of repeated vibration and fatigue. Alternatively, foreign materials, sometimes referred to as crud, can be trapped in the gap and can chemically attack the tube. Thus, it is desirable to close the gap in order to eliminate or reduce the vibration and prevent crud entrapment. The tube can be secured in the tube support by a variety of different methods that accomplish this purpose. Currently, this expansion is most economically performed by a tube rolling technique which mechanically expands the tube outer diameter against the circumference of the tube aperture in the tube support by permanent plastic deformation of the tube using a mandrel and a series of circumferential rollers. The rollers are forced against the tube by the mandrel which expands the tube. This mechanical action can thin the tube as the action of the rollers against the tube inner diameter can also remove material as the tube is expanded. This tube expansion ideally expands the tube outer diameter into contact with the circumference of the tube aperture in the tube support uniformly 360° about this circumference. Such ideal expansion is sometimes referred to as touch expansion. Not all expansions are ideal. On occasion, the tube can become highly distorted or upset along one or more arc segments of the aperture in the support plate so as to extremely hinder or prevent its removal, particularly if the location of the rollers with respect to the tube support is not carefully controlled. This undesirable expansion is sometimes referred to as an over-expansion, and is to be avoided when possible. The problems associated with tube rolling introduce into the tubes manufacturing variables that can lead to increased failure rates. Reliability can be improved if these variables are eliminated. In addition, tube rolling is accomplished by rolling each tube individually into each tube support.

Tube expansion of tubes in structures such as tube supports, tube sheets and baffles has been accomplished by an ideal expansion of the tube outer diameter against the inner diameter of such structures. The nuclear industry has accomplished this expansion in a controlled manner. For example, U.S. Pat. No. 4,889,679 outlines apparatus for locating a tube in relation to a tube sheet, baffle or support plate in a nuclear reactor steam generator and then expanding the tube sheet against the support plate once it has been properly located. As can be appreciated, the proper location of the tube in relation to a related structure in a nuclear reactor is exceedingly important, as failure to properly expand the tube or expanding an improperly located tube can lead to premature tube failure, having disastrous consequences, including contamination of non-radioactive secondary water with radioactive primary water, which can lead to radioactive contamination of the entire secondary system, which is supposed to remain non-radioactive. To achieve the necessary degree of quality assurance and reliability demanded by the nuclear industry, this patent sets forth a combination of an eddy current probe and an expandable bladder-type probe. The probe is inserted into each tube in the steam generator and the location of the tube with respect to an individual tube support plate, baffle plate or tube sheet is determined to within three thousandths of an inch (0.003"). The expandable bladder is then activated and the tube is expanded. The probe is then moved to locate the next support plate, baffle plate or tube sheet. The eddy current probe can inspect the extent of the expansion of the tube into the apertures in the structure. As one may expect, this operation is expensive and time consuming, considering that a steam generator includes hundreds and even thousands of tubes with multiple supports, baffle plates and tube sheets. However, due to the criticality of the operations and the overriding concern with safety, this time consuming, costly operation is acceptable, while cost-savings improvements that do not provide at least the same reliability and safety are not acceptable, and indeed will not even be considered.

A related patent is U.S. Pat. No. 4,649,493 which describes a similar apparatus for locating, inspecting and expanding a tube at a tube location adjacent to a support plate, baffle plate or tube sheet in a nuclear reactor steam generator. Again, because of the reliability and safety concerns in a nuclear reactor, each tube is expanded sequentially at each location as a precise determination is made of the location of the tube with respect to the related structure.

Another patent, U.S. Pat. No. 5,791,046 to Schafer issued Aug. 11, 1998, incorporated herein by reference, sets forth apparatus for expanding a sleeve in multiple locations against a defective region of a tube to accomplish a tube repair in an application such as a nuclear reactor heat exchanger. The apparatus disclosed in the patent utilizes the eddy current detector to locate the location and size of the defect and a plurality of bladders to expand a single sleeve in a plurality of locations to secure the sleeve against the tube and to reduce the leak rate between the tube and the sleeve. The location of the sleeve with respect to the tube defect is the critical aspect of the Schafer invention, as the defect can be located at any position along the tube.

What is needed is apparatus that permits the simultaneous expansion of a tube at multiple locations along its length corresponding to the position of the aperture in the tube support. This expansion should both simultaneously expand the tube against the tube support apertures, while assuring reasonable accuracy of the location of the tube with respect to the tube support, but without requiring overly accurate determinations of the location of the tube with respect to the tube support. The apparatus should also produce ideal expansions to uniformly expand the outer diameter into contact with the circumference of the tube aperture.

SUMMARY OF THE INVENTION

The present invention allows for the production of a plurality of uniform expansions of a tube in a plurality of support plates simultaneously. A plurality of tubes are expanded into apertures of the support plates in a repetitive manner, each individual tube being expanded into an aperture of each of the plurality of tube support plates simultaneously so that all expansions of the tube into the tube support are accomplished in the tube without the removal from the tube or repositioning of the bladders of the tube expander assembly in the tube. The operation is repeated until all of the tubes are expanded into their corresponding tube supports. Ideally, the expansions are accomplished in a simultaneous expansion of the tube expander assembly. The tube expander assembly of the present invention, when positioned in accordance with the present invention such that each bladder is centered on each land or opening of the support plates surrounding the tube, will precisely control the degree (magnitude) of expansion of each tube against the tube support aperture by controlling the amount of pressure applied to the bladders.

The tube expander spindle assembly of the present invention comprises a plurality of bladder assemblies that are positioned within a tube such that each bladder assembly is adjacent to a support plate when the tube expander assembly is positioned within a tube assembled into the tube support plates of the heat exchanger. Each bladder assembly includes a probe assembly and an expandable bladder, the expandable bladder being mounted on the probe assembly. The bladder assembly is smaller than the tube into which it is inserted. The number of bladder assemblies utilized corresponds to the number of tube supports in the heat exchanger surrounding the tube. Each probe assembly has a first member and a second member. Each member is apertured along its axial length, the aperture extending the axial length of the member. The first member includes a body having a first diameter, the first diameter being smaller than the inner diameter of the tube into which it is to be inserted. The first member has an axially-extending shaft extending away from the body, the diameter of the shaft being less than the first diameter of the body. The shaft has a cylindrical portion for receiving the expandable bladder. The expandable bladder is assembled over the shaft. When assembled, the expandable bladder has a diameter that is smaller than the inner diameter of the tube into which it is to be inserted. The shaft includes a first means for attachment at its an end opposite the body. This means for attachment, which can be any suitable and well-known attachment means, is to sealably connect the first member and the second member. The body includes a second means for attachment, opposite the first means of attachment, on the shaft to allow the end of the bladder assembly having the body to be connected to additional structure, as will be explained. The shaft has a second aperture extending in a substantially radial direction between an outer surface of the shaft and the axial aperture. This substantially radially oriented aperture allows for a fluid communication with the axial aperture, so that when the expandable bladder is assembled over the shaft, a pressurizing fluid can be used to pressurize and expand the bladder by flowing pressurized fluid axially along the shaft and then through the substantially radial aperture into the bladder. The second member of the probe assembly includes an axial first end and a second end. The axial first end of the second member includes a means for attachment to mate with the corresponding means for attachment of the first member in order to secure the first member and second member together, with the bladder being captured therebetween. The second end of the second member includes a means for attachment to allow the end of the bladder assembly having the second member of the probe assembly to be connected to additional structure, as will be explained.

The tube expander spindle assembly of the present invention includes a first connection tube of preselected length extending axially and having a first end and a second end, with a hard stop mounted to the first end. The first connection tube also includes a means for attachment at the second end for removably attaching the connection tube to one of the members of the probe assembly. The connection tube further including an axially extending aperture so that there is fluid communication along the first connection tube to the probe assembly when assembled thereto. The hard stop, which may be integral with the first connection tube or which may be a separate component, controls the distance that the tube expander assembly can be inserted into the tube, and is seated against a predetermined feature of the chiller, such as the tube sheet. Control of the distance from this predetermined feature is critical in assuring that the bladder assemblies are positioned within the tube adjacent the tube supports. Because the tube supports are at fixed, known distances within the heat exchanger, a tube properly assembled within the heat exchanger can receive a tube expander spindle assembly spindle with the bladders positioned with respect to a predetermined feature at the proper locations corresponding to tube supports. The means for attachment at the second end of the connection tube is adapted to mate with the means for attachment of the bladder assembly.

The first connection tube is attached to a bladder assembly. Additional connection tubes of preselected length, each tube having a first end and a second end and an axially extending aperture, include a means for attaching at each end. The preselected length of the connecting tubes is the predetermined distance between the tube supports, such that each assembled bladder will be adjacent a corresponding tube support. The attachment means at each end of the connection tube are adapted to attach to one of the attachment means of one of the members of the probe assembly. The assembly of the bladder assemblies and the connection tubes, which serve as connecting rods, provides the tube expander spindle assembly. The preselected length of each of the connection tubes in the tube expander spindle assembly provides a tube expander spindle assembly that, when properly assembled into the tube, is positioned adjacent to the predetermined reference feature of the chiller, the bladder assemblies in the tubes being adjacent to the tube support apertures. The predetermined reference feature may be the stop positioned adjacent a tube sheet or any other means for positioning the bladder assemblies adjacent the tube support apertures.

The tube expander spindle assembly of the present invention includes a means for fluidly sealing the means for attaching the connection tubes to the bladder assemblies. The axially extending apertures of the connection tubes and the bladder assemblies, when properly assembled to form the spindle, places the axially-extending apertures in fluid communication with one another in a sealed arrangement. The means for fluidly sealing the attachments between these mating components is to minimize or eliminate the leakage of pressurizing fluid across the attachment means so that sufficient pressure can be applied to the bladder assemblies to expand the bladders against the tube and plastically deform the tube against the tube support apertures at the preselected locations corresponding to where the tube passes through the tube support. This sealing means may be part of the attachment means of the mating components or may be a separate item.

At the opposite end of the tube expander spindle assembly from the first connection tube, the axial aperture must be sealed to prevent the escape of the pressurizing fluid. The means for sealing the opposite end can be any effective device that captures (or prevents the escape of) the pressurizing fluid so that the necessary pressure can be reached. It may be, for example a plug applied to the last bladder assembly, or the last bladder assembly may be designed without a means for attachment at one end, but rather with an axial aperture that is closed at one end. The terminal apparatus is applied to the last bladder assembly or is integral with the last bladder assembly to provide a means for sealing the axially extending aperture at the end of the tube expander spindle assembly.

The tube expander spindle assembly of the present invention also includes means for pressurizing the tube expander assembly spindle, the means for pressurizing the spindle being in fluid communication with the axial apertures of the connecting tubes and then radially to the bladders so as to provide the spindle with apertures in fluid communication with one another and with the bladders so that pressure can be applied to the tube. The means for pressurizing permits the introduction of pressurizing fluid into the apertures, thereby raising of the pressure of the fluid within the apertures. This pressure is then applied to the bladders, which expand substantially uniformly outwardly against the tube and plastically deform the tube when the outwardly applied pressure exceeds the plastic yield point of the tube material.

The primary advantage of the present invention is that a tube can be simultaneously expanded at a plurality of locations corresponding to tube sheets and tube supports so that one tube can be expanded into the tube supports of a heat exchanger in one operation, thereby drastically reducing the time required for tube expansion. In addition, tube expansion using the tube expander assembly of the present invention can be accomplished by one man rather than the two required by the prior art tube rolling process, further reducing the number of man-hours required to accomplish tube expansion.

Another advantage of the present invention is that tubes expanded hydraulically or pneumatically in accordance with the present invention are more uniformly expanded with less surface deformation. In addition, because the expansion process of the present invention utilizes expandable bladders that do not remove material from the tube, the reliability of the tube expansion operation should increase with fewer resulting tube failures in the region of the tube expansion.

Still another advantage of the present invention is that the expansion can be better controlled in the expansion area to preclude either overexpanding the tubes or in providing tubes having minimal contact with the support plate.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

The tube expander apparatus of the present invention provides an improved method for expanding tubes into tube supports and tube sheets for chiller applications. In addition to providing apparatus and methods for expanding a tube simultaneously at a plurality of locations along the tube where the tube passes through a tube support plate, the apparatus also overcomes potential problems in tubes due to out-of-tolerance conditions resulting from tube support plate/tube land misalignments, out-of-tolerance (oversize) support plate apertures and variations in tube wall thicknesses.

Figure 1:
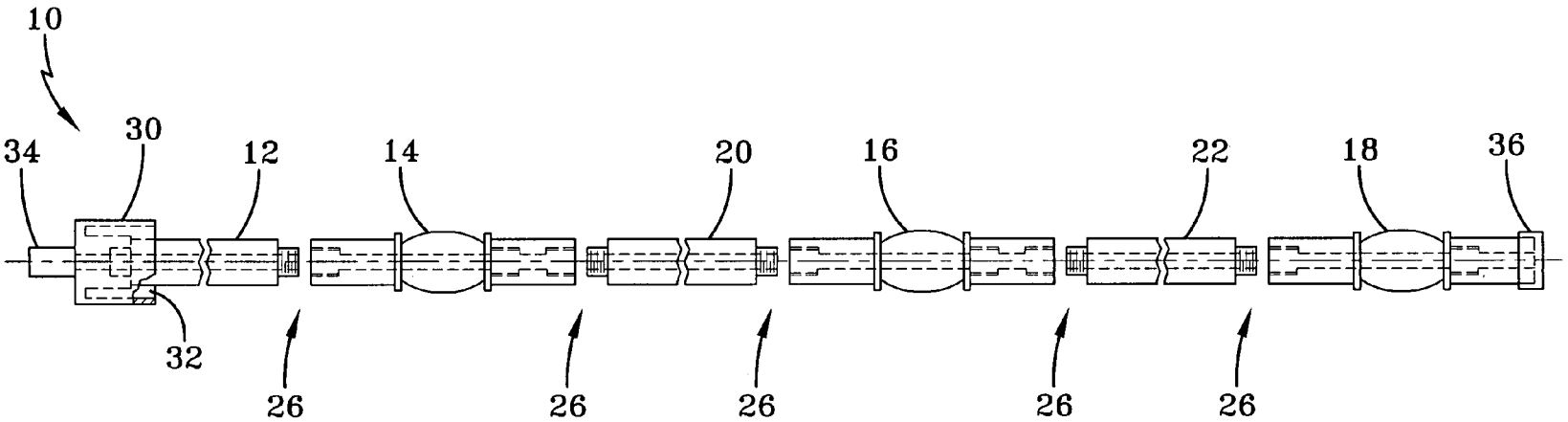
FIG. 1 is a perspective view of a tube expander spindle assembly of the present invention.

Referring now to FIG. 1, which is a perspective view of the tube expander spindle of the present invention, comprising a first connection tube 12, and three bladder assemblies 14,16,18. Connection tube 20 spans the distance between bladders assemblies 14 and 16, while connection tube 22 spans the distance between bladder assemblies 16 and 18. Connection means 26 allow the connection tubes to be attached to the bladder assemblies. The connection means can be any known mechanical connection that permits the connection tubes and bladder assemblies to be attached to one another. Thus, the connection means can be, for example, a collect arrangement, interlocking collars or a locking dovetail arrangement between the bladder assemblies and the connection tubes. In a preferred embodiment, the connection means is a threaded connection. The male thread can be located either on connection tube 12, 20, 22 or bladder assemblies 14,16,18. The corresponding female thread is located on the remaining or opposed piece to provide the fit-up.

First connection tube 12 extends in an axial direction, having a first end and a second end. The connection means 26 is located on or at the second end. First connection tube 12 includes a means for locating the tube expander assembly within the tube relative to a datum, here a hard stop 30 located at an end opposite connection means 26. The hard stop 30 provides a means for locating the spindle assembly with respect to the chiller assembly. Because the distance from the chiller tube sheet to the first tube support is a known fixed distance which can be measured, the distance from hard stop 30 to first bladder assembly 14 can be preselected to correspond to this known fixed distance. When spindle assembly 10 is assembled into a tube in a tube sheet and hard stop 30 is brought up against the tube sheet face, which serves as the reference surface or datum surface, bladder assembly 14 is positioned within the tube and adjacent to the tube support aperture. Hard stop 30 preferably further includes a counter bore 32 in the surface facing the tube sheet to accept a tube that may be extending away from the tube sheet. The counter bore 32 prevents an extending tube from hampering the hard stop from contacting the reference surface, here the tube sheet. Hard stop preferably also includes an extension 34 or adaptor to allow hook-up to a pressurizing means such as a pump, although the hook-up may be provided by a hook-up to the first connection tube 12. The end of the tube expander spindle assembly 10 opposite the first connection tube 12 and adjacent to or as part of the last bladder assembly in the tube expander spindle assembly includes a fluid stop 36. Fluid stop 36 prevents fluid, preferably hydraulic, from exiting the opposite end of spindle assembly 10. Fluid stop 36 may be an integral part of the final bladder assembly 18, if desired. In this embodiment, that is, with fluid stop 36 as an integral part of the final bladder assembly, bladder assembly 18 in FIG. 1, the final bladder assembly is then not interchangeable with bladder assemblies 14, 16. In a preferred embodiment as shown, fluid stop 36 includes a means for attachment that permits it to be sealingly attached to bladder assembly 18. For example, if bladder assembly 18 includes female threads, then fluid stop 36 includes corresponding male threads that permit fluid stop 36 to be threaded into bladder assembly 18. Alternatively, fluid stop 36 may be attached to a connection tube 22 that is attached to bladder assembly 18. A special connection tube that is closed at one end, or a bar adapted for sealing connection to spindle assembly, may be attached to the distal end of the spindle. Any of these embodiments is acceptable, along with any other fluid stop configuration, so long as the stop configuration prevents leakage of fluid from the tube expander spindle beyond the last bladder assembly 18 so that the tube expander spindle 10 can be pressurized.

Each of the connection means 26, threaded connections in the preferred embodiment further includes a means for preventing leakage of hydraulic fluid. Any well-known means for preventing leakage of a fluid may be used. This means may be a mechanical device, such as an o-ring seal. The sealing means may be any simple commonly used item, such as thread sealant, plumbers putty or Teflon tape. Any means for sealing the connection between the components of the tube expander spindle may be used, as long as tube expander spindle assembly 10 can be pressurized. The various means for providing such sealing are well known in the art and are not a novel part of the present invention.

Figure 6:
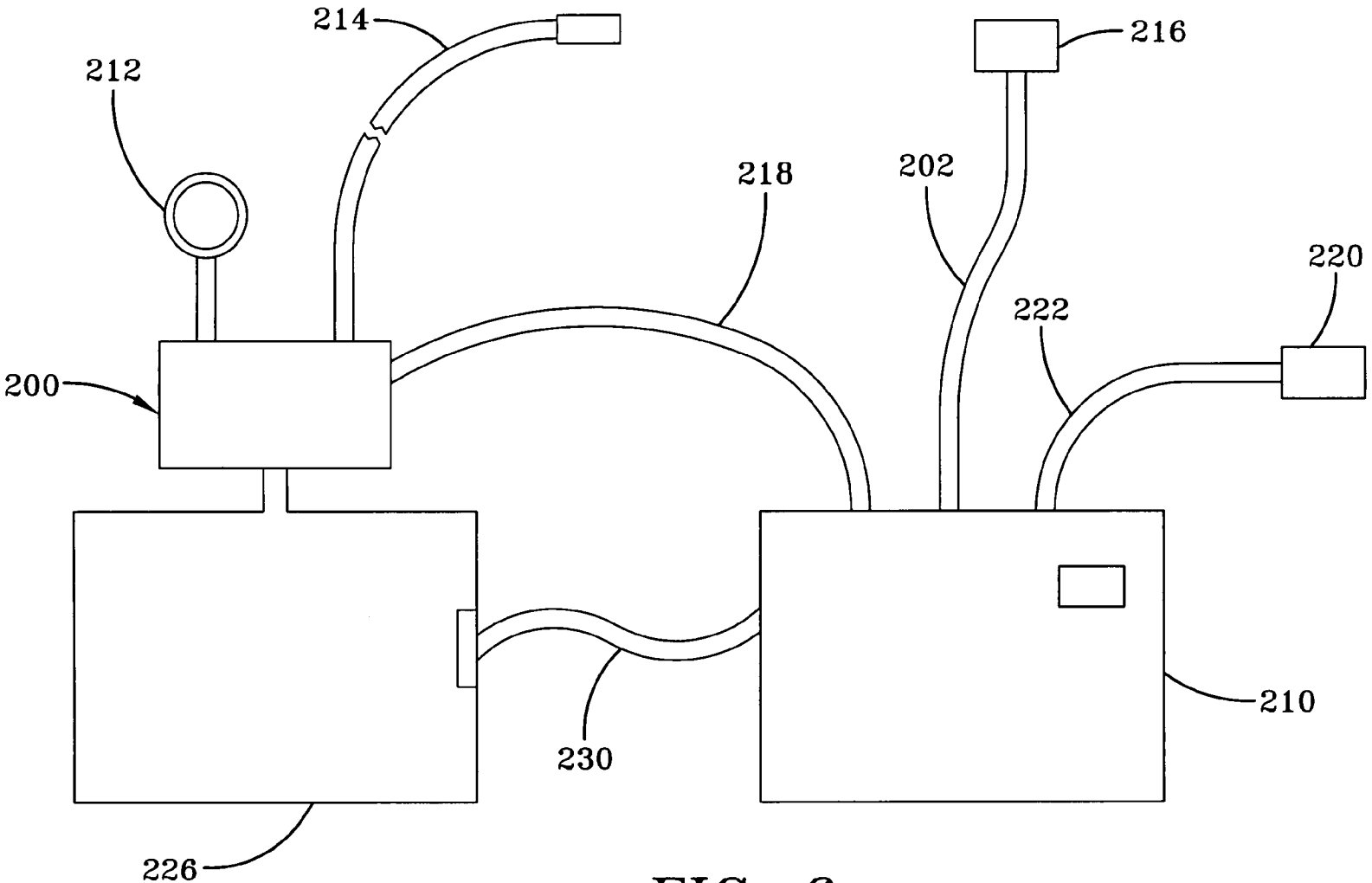
FIG. 6 is a diagram of the pump and controller of the present invention.
Figure 7:
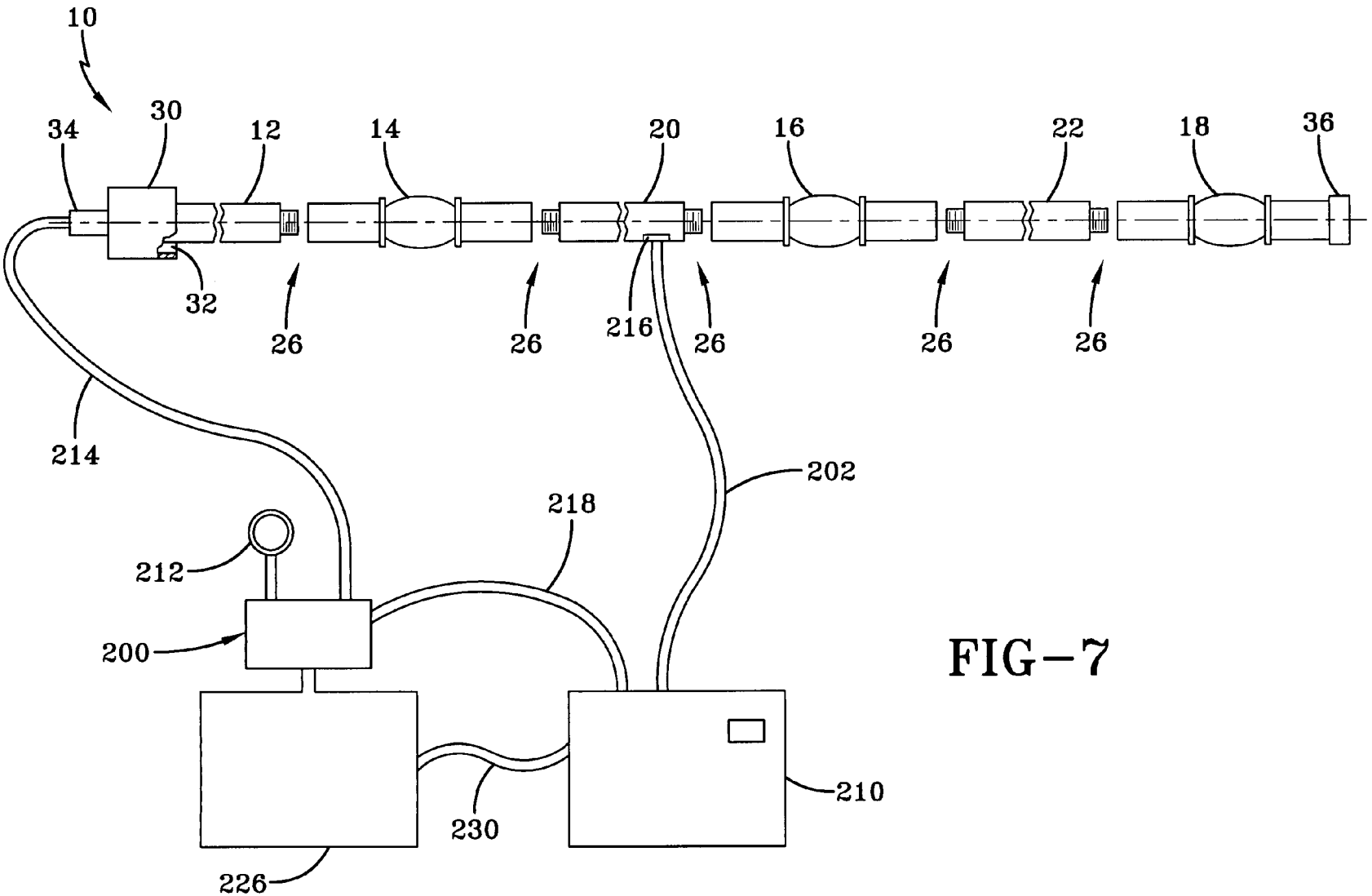
FIG. 7 is a schematic of the tube expander spindle assembly of the present invention attached to the pump and controller.

The tube expander spindle assembly 10 of the present invention is connected to a means for pressurizing (not shown in FIG. 1) the tube expander spindle assembly 10. The means for pressurizing, in the preferred embodiment, preferably includes a hydraulic fluid, a controller, a pump, and a connection between the pump and tube expander spindle assembly 10 of the present invention, such as a flexible tube or hose, to provide fluid communication between the spindle assembly and the pump, such as is shown in FIGS. 6 and 7. The pump may include a reservoir for the hydraulic fluid or the reservoir may be attached to the pump. However, the reservoir and pump will simply be referred to as the pump.

Figure 2:
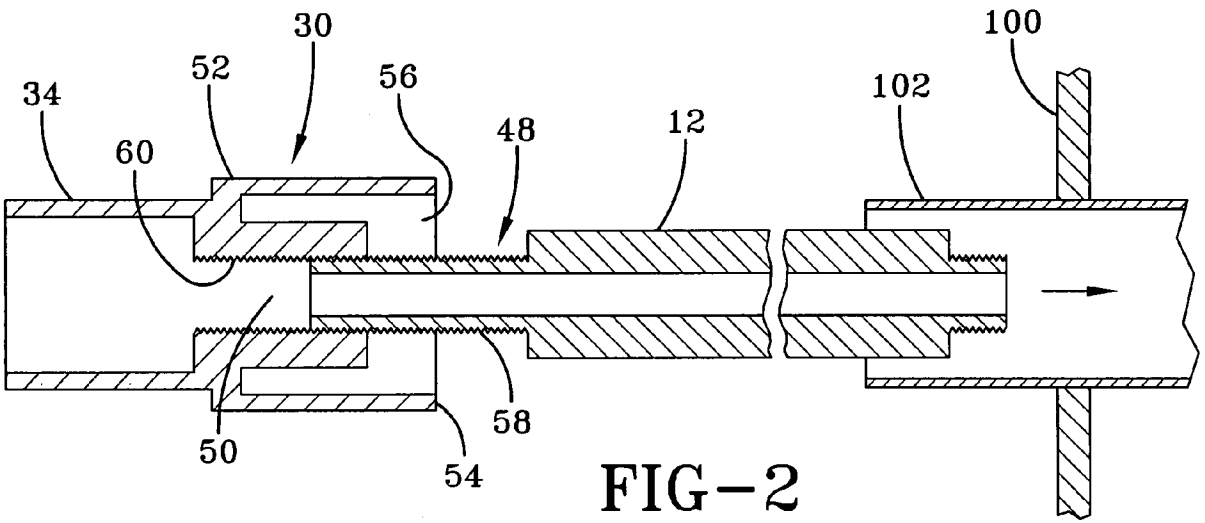
FIG. 2 is an enlarged view of the hard stop attached to the first connection tube and inserted into a tube.

FIG. 2 is an enlarged view of a preferred hard stop 30 of the present invention. Stop includes an axially-extending central bore 50. A first end 52 of hard stop 30 includes a seat surface 54. This seat surface seats against a known feature of the chiller, such as the tube sheet 100. First end also includes a counter bore 56 which is larger than central bore 50 and larger than tubes extending from the chiller tube sheet, which tubes typically have an outer diameter of about ¾ inch (about 0.750 inches) and an inner diameter of about 0.625 inches. Hard stop 30 is assembled by placing counter bore 56 over a tube 102 until seat surface 54 contacts the reference feature, here the tube sheet. Counter bore 56 can accommodate tubes that extend different distances away from the tube sheet, as some tube length difference is common. Central bore 50 includes an attachment means for attachment to the tube expander spindle assembly 10, and specifically to the first connection tube 12 of tube expander spindle assembly 10. Central bore 50 can be threaded, which allows for adjustment of the length of tube expander spindle assembly 10 by adjustment of the first connection tube 12. In one arrangement for accomplishing this adjustment, first connection tube 12 includes male threads 58 that mate with female threads 60 of central bore 50. There are sufficient male threads to allow for the hard stop 30 to be threaded along first connection tube 12. The position of seat surface 54 of hard stop 30 with respect to the threads controls the length of first connection tube 12. The hard stop can be adjusted by threading it with respect to the first connection tube 12 to provide a preselected length from the seat surface, which will contact the chiller tube sheet, to the opposite end of the first connection tube thereby providing the required preselected length of first connection tube 12 that is to be inserted into the tube. These threads are typically located at a first end 48 of first connection tube, while the mating threads on the hard stop are internal. Since the distance between the tube sheet front surface 100 to the front surface of the first tube support is known by measurement, hard stop 30 can be threaded over first connection tube 12 of tube expander spindle assembly until the length of first connection tube 12 extending away from seat surface 54 and into the tube matches the known distance between the front of tube sheet 100 and the first tube support, thereby assuring that the first bladder assembly substantially resides in the tube where the tube passes through the aperture in the first tube support. Of course, other means of adjustment to locate the seat surface 54 of hard stop 30 with respect to first connection tube 12 can also be used, such as for example a locking collect extending over first connection tube 12.

Figure 3:
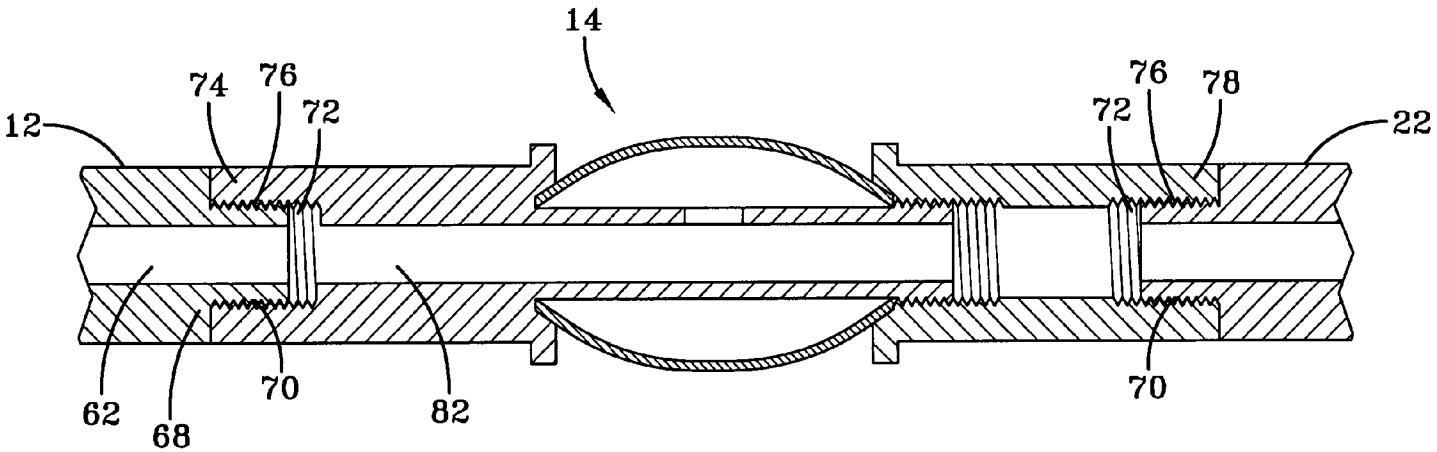
FIG. 3 is cross sectional view of a single bladder assembly attached to a pair of connection tubes.

FIG. 3 is a view of a single bladder assembly 14, 16 or 18, assembled to connection tubes, one at each end of the bladder assembly. The connection means between connection tubes 12 or 22 and bladder assemblies 14, 16 or 18 can be the same. For the purposes of this discussion, only one bladder assembly 14 having connection tubes 12, 22 will be discussed. It is understood that a connection tube 22 can be substituted for connection tube 12 and that bladder assemblies 16, 18 etc. can be substituted for bladder assembly 14. Connection tube 12 includes an axially-extending central aperture 62. Second end 68 of first connection tube 12 includes a means for sealingly engaging bladder assembly 14. In FIG. 3, this sealing arrangement is shown as threads 70 at second end 68 at first connection tube 12 engaged with mating threads 72 at a first end 74 of bladder assembly 14 in the preferred embodiment. It does not matter which component has the male threads and which component has the female threads. A thread sealant 76 preferably is interposed between the threads to prevent leakage of fluid. As noted previously, any sealing arrangement, such as an o-ring or other known method for sealing connections may be used. The specific method of sealing the connection is not an important feature of this invention, only that the connection be sealed to prevent leakage of fluid during pressurization of the bladders. As shown, the sealing arrangement at the second end 78 of bladder assembly is essentially identical, making the bladder assembly ends interchangeable. However, if it is desired to assemble the bladder assembly in the same orientation with every use, the connections can be reversed, that is to say, for example, one end of the bladder assembly can have male threads and the other end can have female threads. Of course, the connection tubes 22 have mating connections, so that the ends of the connection tubes 22 would also have to be assembled in the same orientation with respect to bladder assembly 14. Again, this arrangement is not a limiting feature of the invention. Bladder assembly 14 also includes an axially extending aperture 82.

Figure 4:
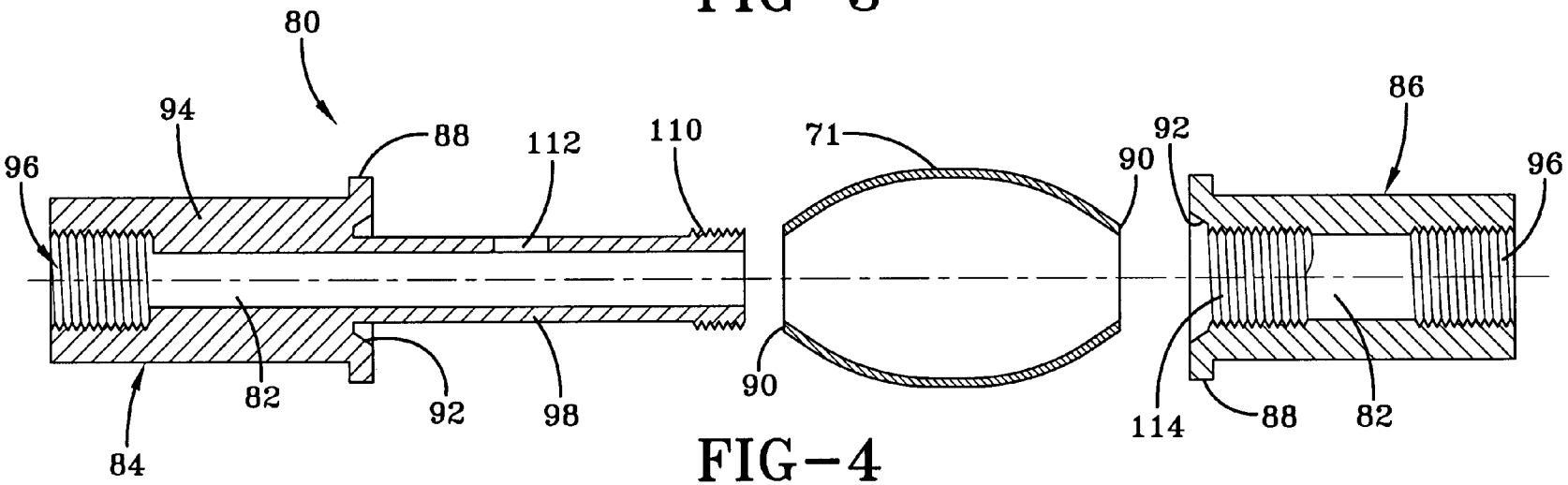
FIG. 4 is an exploded view of the bladder assembly of the present invention.

FIG. 4 is an exploded view of bladder assembly 14 of the present invention showing the bladder 71 and probe assembly 80. The bladder is comprised of an expandable material which can withstand the pressures required to plastically deform the tubes. The bladder material should be able to withstand multiple expansions without requiring replacement. Each probe assembly 80 includes a first member 84 and a second member 86. Both the first member 84 and second member 86 include axially extending aperture 82 extending the axial length of each member. Both the first member 84 and second member 86 include a flange 88 with a means for capturing 92 the ends 90 of bladder 71. Flange 88 has an outer diameter which is smaller than the inner diameter of the tube into which bladder assembly 14 is inserted. Ends 90 of bladder 71 preferably are tapered, while the center of the bladder has an outside diameter about equal to or less than the inner diameter of the tube into which it is installed. In the embodiment shown, each flange 88 includes a means for capturing 92 which comprise counter bores in flanges 88, the counter bores being about the same diameter as the diameter of the ends 90 of the bladder. The members 84, 86 and the bladder 71 preferably are tapered in the vicinity of their end points to allow for a continued seal when bladder 71 is pressurized. The taper is preferably about 30° to about 70°, and most preferably is about 45° to about 60°. The bladder will thus expand from hoop stress and have a tendency to contract in length when pressurized. The tapered ends provide a preferred embodiment which allow for the bladder contraction while still providing a good seal. However, any other arrangement that captures the bladder while allowing it to expand on pressurization will provide an acceptable means for capturing 92.

First member 84 includes a body portion 94 having means for attachment 96 of first member to a connection tube 12, 22. The means for attachment 96 can be any acceptable means that permits a fluidly sealable attachment to be made. In the preferred embodiment discussed above, connection tubes 12, 22 include male threads as means of attachment, so an acceptable means for attachment 96 in this embodiment include female threads which accept the male threads of the connection tubes. A thread sealant, o-ring seal, gasket or other means for preventing leakage of hydraulic fluid may be used between the threads. First member 84 also includes a shaft 98 extending away from body portion 94. The end of shaft 98 includes means for attaching 110 first member to second member. As shown, means for attaching 110 includes male threads, although any other known means of attachment may be used. Bladder 71 fits over shaft 98 between the threads and extending back into means for capturing 92, counter bore, as shown. The axial length of the bladder is about 1". Shaft 98 includes an aperture 112 that extends in a radial direction from axially extending bore 82 so that there is fluid communication from axially extending bore 82. The location of aperture 112 is such that the bladder 71 is assembled onto shaft 98 over aperture 112.

As previously noted, second member 86 includes a flange with means for capturing 92 the remaining end 90 of bladder 71. Second member also includes a means for attachment 114 to attach second member 86 to first member 84. Here, the means for attachment 114 are female threads that mate with the male threads 110 of first member 84. A sealing means, such as an o-ring, gasket or thread sealant, Lok-Tite®, for example, may be used to prevent leakage of fluid once the members are assembled. The opposed end of second member 86 includes means for attachment of second member to connection tubes 12, 22. As discussed, any acceptable method may be used to attach second member to connection tube 22. In the preferred embodiment, as the connection tube includes a male thread; the means for attachment of second member to connection tube 12, 22 should be a female thread 96. A sealing means, such as an o-ring, gasket or thread sealant, Lok-Tite®, for example, may be used to prevent leakage of fluid once the probe assembly is assembled to a connection tube, or, if at the end of the tube expander spindle assembly, a fluid stop.

Figure 5:
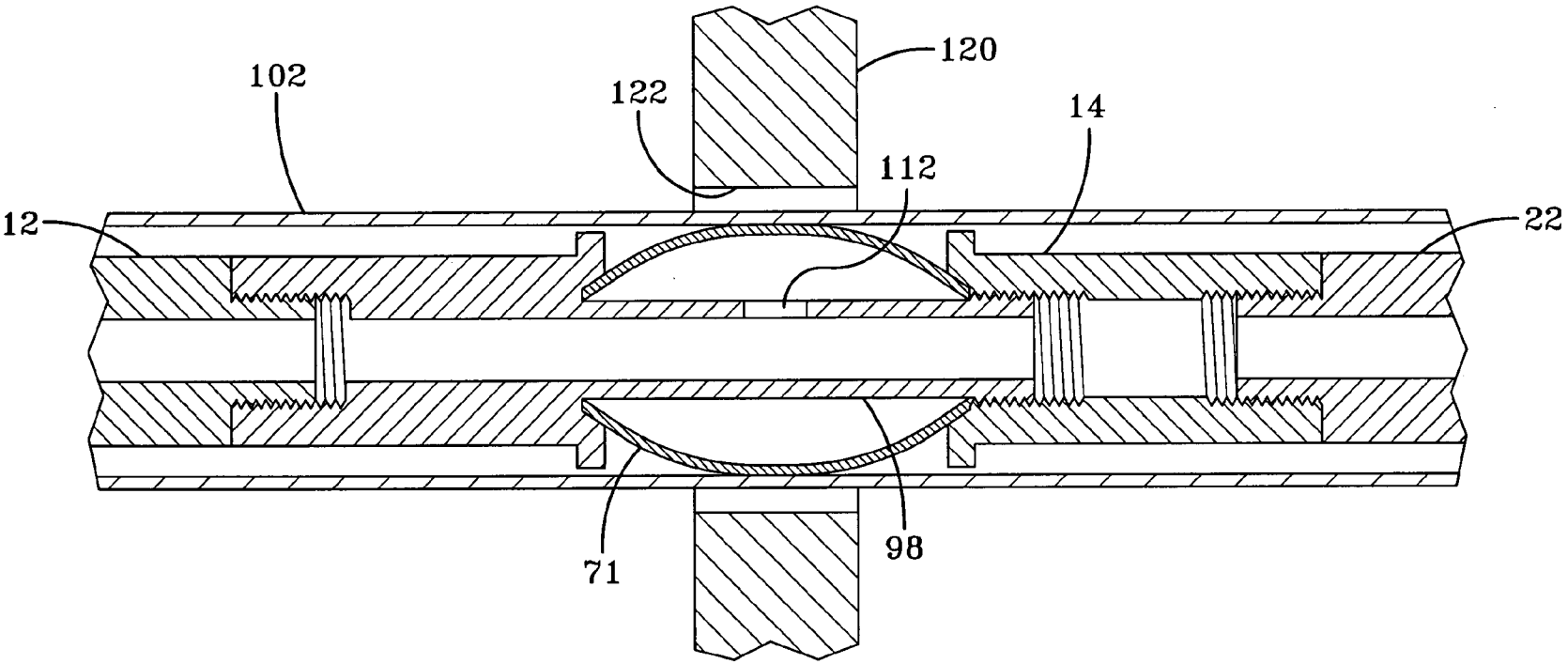
FIG. 5 is a partial, cutaway cross-sectional view of the tube expander spindle assembly of the present invention inserted into a single tube between the tube sheet and first tube support.

FIG. 5 is a partial, cutaway cross-section of the tube expander spindle assembly 10 of the present invention inserted into a single tube. The tube expander spindle assembly 10 is positioned in the tube 102 so that the bladder 71 is positioned within the tube where the tube passes through tube support aperture 122. The connection tubes 12, 22 are assembled to bladder assembly 14.

FIG. 6 is a schematic of the means for pressurizing the tube expander spindle assembly. While any means for pressurizing may be used, FIG. 6 employs a hydraulic system that includes a reservoir for the fluid and a pump. A gage 212 provides a reading of pressure at the pump 200. A sensor also provides a pressure reading to controller 210. The reservoir 226 is in fluid communication with the pump 200, and the pump 200 and reservoir 226 are in communication with controller 210, the pump via line 218 and the reservoir via line 230. The controller 210 also includes sensors that can sense the fluid pressure within the tube, such as sensor 216. Sensor 216 is shown connected to controller 210 via line 202. It will be understood that all communications between the sensor and controller discussed herein may be by hard-wiring, as shown in the FIGS., or may be by means of wireless communications, such as by RF signals. A sensor monitors fluid levels in reservoir 226, which information is fed back to controller 210 via line 230 as shown in FIG. 6. A removable tube 214 is securely connected at one end to the pump and at the other end to the first connection tube 12.

Referring to FIGS. 5, 6 and 7, the controller can activate pump 200 to provide hydraulic fluid to spindle assembly 10. The fluid passes through tube 214, down axial bore of spindle assembly 10 through connecting rods 12, 22, into bladder assemblies such as bladder assembly 14 and through radial aperture 112 in shaft 98. As the pressure applied by the hydraulic fluid increases, bladder 71 expands outwardly, as a result of the hoop stresses applied to it. Sufficient pressure is applied by the hydraulic fluid to bladder 71 to expand the bladder against the inner diameter of the tube and exceed the elastic limit of the material comprising tube 102, thereby causing tube 102 to plastically deform outwardly sufficiently to cause tube 102 to expand against aperture 122 of the tube support 120. This pressure is a known predetermined pressure, and depends upon the plastic deformation strength of the tube, which is material-dependent, and the gap or distance between the outer diameter of the tube and the diameter of the tube sheet aperture. The pressure will thus vary with tube material and fit-up dimensions, but can be readily calculated once these variables are determined. This applied pressure is monitored by the controller 210, which obtains pressure readings from the sensor 216 associated with spindle assembly and from pump 200 via line 218. Once the predetermined pressure is achieved, the controller 210 deactivates the pump 200 and the pressure is released. Because the system is closed and sealed, the pressure applied to the system is substantially uniform, so that substantially the same pressure is simultaneously supplied to a plurality of bladders along spindle 10. The reservoir 226 stores and provides the hydraulic fluid as required. Once the variables of pressure, material, gap etc. are known, the information may be provided to the controller or stored for recall, and the tube expansion can be controlled automatically by activating the system.

While the present invention can be used to expand tubes into tube supports, it can also be used to expand tubes into tube sheets. This can be accommodated by the present invention by applying an additional pair of bladders and positioning these bladders along the spindle corresponding to the location of the tube within the tube sheet, in the same manner as bladders are located with respect to tube support apertures. The expansion of tubes into tube sheets may require a higher pressure. When a higher pressure is required, the higher pressure can be developed in the bladders adjacent the tube sheets without providing a higher pressure to the bladders adjacent the tube supports. This can be done using available techniques. For example, known techniques using bladders that have a different coefficient of expansion at the different locations can be incorporated onto the spindle. Thus, bladders that expand the tube against the tube sheet may be displaced or positioned radially outwardly further than the bladders that expand the tube against the tube support at a given pressure. Alternatively, a mechanical device that increases pressure can be associated with the bladders adjacent the tube sheets, such as the device described in U.S. Pat. No. 4,055,063 as a pressure intensifier. Still another technique may utilize isolation valves to isolate the bladders adjacent the tube supports from the bladders adjacent the tube sheets. In this embodiment, the expansion is done in two steps rather than one, as the first pressurization is done at a first pressure and the second pressurization is done at a second pressure. The bladders 71 adjacent the tube support are isolated from the higher pressure as it is applied to the bladders adjacent the tube sheet. While the expansion of the bladders in the tube adjacent the tube support is not performed simultaneously with the bladders in the tube adjacent the tube sheet, the operations being done in separate pressurizations, the operation is performed without having to move and reposition the spindle in the tube, which results in significant time savings. The process can be programmed into the controller so that the operation can be performed automatically, with controls provide to control the isolation valves, the controller operating these valves automatically. Currently, the expansion of the tubes adjacent the tube sheet is performed in two operations requiring positioning of the bladder or a mechanical rolling device in the tube.

Typical chillers utilize three (3) or four (4) tube supports. The tube supports for the four-tube-support configuration are typically designed to be about 38" apart with a tolerance of ±½". A four tube-support chiller typically includes about 1300 tubes. The three-tube support configuration has tube supports positioned at distances about 42" apart with a tolerance of ±½". Of course, it will be recognized that chillers can be manufactured to have additional support plates or fewer support plates, the number of support pates dependent upon the overall length of the chiller and the support required for the tubes. Similarly, the number of tubes in a chiller can be varied. The plate comprising the tube support is about ±½" thick. The distance between the tube sheet and the tube support at either end is also a fixed distance. The first step in the expansion operation is to accurately determine the dimensions between the tube sheets and the tube supports so that bladder assemblies 14, 16, 18 can be positioned at an appropriate location along tube support spindle 10. As should be obvious, the accumulation of tolerances can result in some variation. The tube expander assembly of the present invention can successfully expand tubes without overexpansion even when the bladder assemblies 14, 16, 18 are offset by about ½". Those skilled in the art will recognize this offset as ±½" tolerance, which is to say that successful tube expansion can be accomplished even when the bladder 71 is positioned at an edge of the tube support plate. However, the risk of overexpansion of a tube increases as the deviation from this tolerance increases.

In a simple application, for a chiller using a three-tube support application, a bladder assembly 18 is selected having a fluid stop 36 applied to one end of bladder assembly 18. One end of connection tube 22 is sealingly attached to the end of bladder assembly 18 opposite stop 36. A second bladder 16 is sealingly attached to connection tube 22, the length of connection tube 22 being selected so that the distance between bladder 71 of bladder assembly 18 and bladder 71 of bladder assembly 16 equals the distance between tube supports opposite a first tube sheet. Similarly bladder assembly 16 and bladder assembly 14 are assembled to a second connection tube. It should be obvious that connection tubes 22 of slightly varying lengths, for example about ¼" length variations, can be available and selected for use depending upon the measured distance between the tube supports. First connection tube 12 to which is assembled hard stop 30 is then sealingly connected to bladder assembly 14. Because hard stop 30 on first connection tube 12 is adjustable, as previously discussed, hard stop 30 is adjusted so that the distance from seat surface 54 of hard stop to bladder assembly 14 corresponds to the distance from the face of the first tube sheet to the first tube support. Once this adjustment is completed, the spindle assembly 10 can be assembled into a tube by inserting spindle assembly until seat surface 54 of hard stop 30 contacts the tube sheet face. The counter bore 56 on hard stop will fit over any portion of the tube extending from the tube sheet face.

After spindle assembly 10 is assembled into a tube so that each bladder is adjacent to a tube support as shown in FIG. 5 and the assembly is conveniently connected to pump 200 and control box 210, shown in FIG. 6 so that the spindle assembly can be pressurized. The pump includes a pressure gage 212, a reservoir 226 for the hydraulic fluid, preferably water, and a means to connect tube 214 and the pump to tube expander spindle assembly 10. This can be accomplished with a tube having fastening means connected to first connection tube 12 or to hard stop 30 depending upon the configuration of the spindle. A pressure sensor 216 in the pump or its line is monitored by controller 210, as shown in FIG. 6 connected to controller by line 218. A means 230 for activating and inactivating pump 200, shown in one form as a line having a switch controlled by controller 210 is shown in FIG. 6. Any other well-known apparatus for activation and inactivation may be used for this operation. A remote switch 220 to start the pressurization is also connected to controller 210 as shown by line 222. Controller 210 is also configured to monitor a remote sensor in spindle assembly 10, here as shown by line 202. It will be understood that sensors can be monitored by controllers by any other means such as RF signal if desired. Pressurization for copper-turbo tubes having an inner diameter of about 0.625" and a nominal outer diameter of about 0.750" is successfully accomplished without overexpansion at a pressure of about 3200 psig. A copper-turbo tube is a copper tube that includes a fin to improve heat exchange, as is well known in the art. As used herein, a copper tube includes tubes manufactured from copper that includes a small amount of alloying elements. Upon activation of the pressurization cycle, the tubes are plastically deformed against the tube sheet apertures. This pressurization can be automatically controlled by the controller 210, once switch 220 has been activated. The pressure can be driven to a predetermined, preset level and held at this level for a preselected time before being cycled off by the controller. Alternatively, it can be manually cycled on and off. FIG. 7 provides a schematic of the tube expander assembly of the present invention.

While the above example contemplates expanding a copper tube against three tube supports using three bladders, one skilled in the art understands that the present invention can be arranged to expand tubes into any number of tube supports, as dictated by the design of the chiller. In addition, while the example sets forth expansion of copper tubes, the invention can be used in any other chiller application using tubes of a different material, such as copper-nickel tubes, stainless steel tubes and titanium tubes. Of course, these higher strength materials will require a higher pressure in order to achieve expansion, as the elastic limit at which plastic deformation begins is higher.

Figure 8:
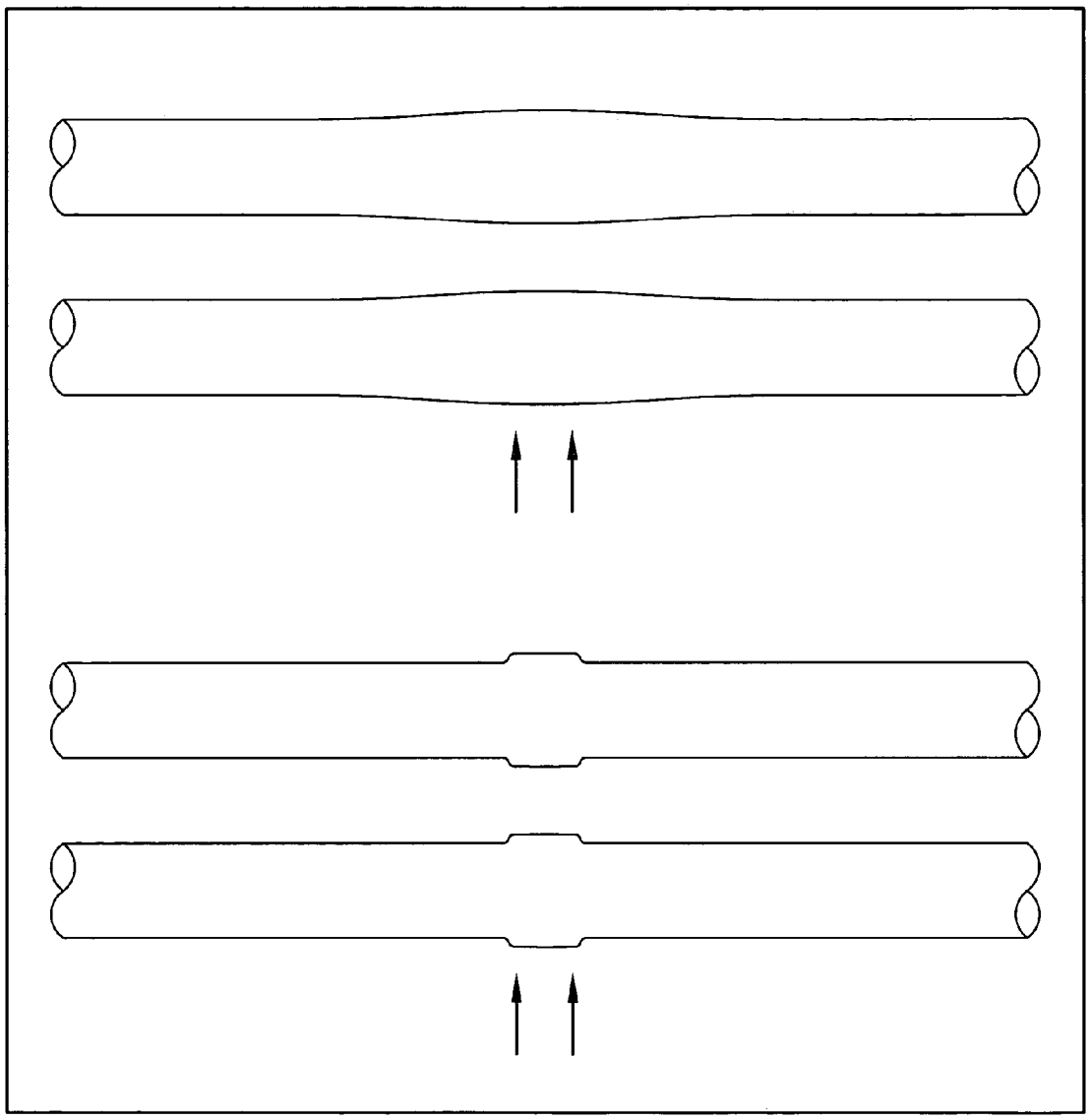
FIG. 8 is a photograph of the tubes, one expanded hydraulically using the device of the present invention, and one expanded using a prior art tube rolling process.

The tube expansion process of the present invention utilizing the tube expansion assembly of the present invention produces a very discrete area of uniform expansion around the circumference of the tube. This uniform expansion is not evident in tubes rolled by the prior art mechanical expansion methods, which display only a hint of tube expansion. This contrast is visible in FIG. 8, which displays a pair of hydraulically expanded tubes in the bottom portion of the figure and a pair of tubes expanded by the prior art mechanical process in the upper portion of the figure.

The embodiment of the present invention utilizes connection tubes having slightly varying lengths that are selected to match the distance of a measured feature of the chiller, either between adjacent tube supports or between tube sheets and tube supports, if tube sheet rolling is to be accomplished. However, it is possible to make the connection tube length itself adjustable. This can be done in a number of ways. For example, with reference to a connection tube 22, it is possible to provide a connection tube that is slightly undersize along with a series of spacers having an axially extending aperture that differ in length by a fixed amount, for example ¼". Each spacer is designed to have a first end with a mating attachment means for attaching to the attaching means of the connection tube. For example, if the end of the connection tube is a male thread, then the first end of the spacer has a female thread. The opposite end of the spacer has an attachment means that allows it to be attached to a bladder assembly. For example, if the bladder assembly has female threads, then the opposed end of the spacer is provided with mating male threads. In this manner, an appropriate spacer can be attached to the end of the connection tube once the measured distance of the feature of the chiller is known. Alternatively, the connection tube can be fabricated slightly oversize (that is, slightly longer) for example by ±½", with threads and a diameter slightly less than the mating thread diameters of a member of the mating probe assembly at an end where it mates up to the bladder assembly, and at least one of the first and second members of the probe assembly can be provided with extra mating threads to provide a total thread length of at least 1". These extra threads in the at least one of the probe assembly members allows the connection tube to be threaded into the at least one member of the probe assembly until the desired length of the connection tube is achieved.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A tube expander spindle assembly, comprising:

a plurality of bladder assemblies, each bladder assembly having an axial first end and an axial second end, each end having a means for attachment, and an expandable bladder positioned between the first end and the second end in fluid communication with the first end and second end;

a first connection tube of preselected length having a first end and a second end with a means for locating the first connector tube relative to a datum mounted to the first end, and means for attachment at the second end or removably attaching the first connection tube to an axial end of one of the bladder assemblies, the connection tube further including an axially extending aperture in fluid communication with the bladder assembly;

a plurality of additional connection tubes of preselected length, each tube having two axially-opposed ends, with a means for connection at each end for attaching one end of the connection tube to an axial end of one of the bladder assemblies of the plurality of bladder assemblies and the remaining end to an axial end of another of the bladder assemblies of the plurality of bladder assemblies, each of the plurality of the connection tubes further including an axially extending aperture to provide fluid communication between the attached the bladder assemblies; and means for fluidly sealing a second end of the last bladder of the plurality of bladder assemblies.

2. The expander spindle assembly of claim 1 wherein the means for locating the first connector tube is a hard stop.

3. The expander spindle assembly of claim 1 further including means for fluidly sealing the means for attachment at the second end of the first connection tube and the axial end of the bladder assembly, and between the means for connection at the end of the plurality of connection tubes and the means for attachment at each end of the plurality of bladder assemblies.

4. The expander spindle assembly of claim 1 further including a fluid and means for pressurizing fluid in the expander assembly.

5. The expander spindle assembly of claim 4 wherein the means for pressurizing the fluid includes a pump.

6. The expander spindle assembly of claim 5 wherein the pump is a pncumatic pump and the fluid is a compressible gas.

7. The expander spindle assembly of claim 5 wherein the pump is a hydraulic pump and the fluid is a hydraulic fluid.

8. The expander spindle assembly of claim 5 further including a controller to monitor and control expansion of the bladder assemblies.

9. A tube expander spindle assembly, comprising:

a plurality of bladder assemblies, each bladder assembly including a probe assembly and an expandable bladder, each probe assembly comprising a first member and a second member, each member having on aperture axially extending the length of the member, the first member further including a body with an axially extending shaft, the shaft having a cylindrical portion for receiving the bladder with a first means for attachment at an end opposite the body, the body further having a second means for attachment opposite the first means, the shaft having a second aperture extending between an outer surface of the aperture and the axial aperture, the second member including a first end and a second end, the first end including a third means for attachment to mate with the first means for attachment of the first member in order to secure the first member and second member together, the second end including a fourth means of attachment;

a first connection tube of preselected length having a first end and a second end, with a hard stop mounted to the first end to control the length of the first connection tube from a preselected reference surface and a means for attaching at the second end for removably attaching the connection tube to one of the members of the probe assembly, the connection tube further including an axially extending aperture;

a plurality of additional connection tubes of preselected length, each tube having a first end and a second end, with a means for attaching at each end for attaching the end of the connection tube to one of the members of the probe assembly, each of the plurality of the connection tubes further including an axially extending aperture;

a means for fluidly sealing the means for attaching the connection tubes to the bladder assemblies;

wherein the axially extending apertures of the connection tubes are in fluid communication with the apertures in the bladder assemblies when assembled to bladder assemblies to form a tube expander assembly spindle;

a means for scaling the apertures located at an opposite end of the tube expander assembly spindle horn the first connection lube; and means for pressurizing the tube expander assembly spindle, the means for pressurizing in fluid communication with the apertures in the bladder assemblies and the connection tubes.

10. The apparatus of claim 9 including a controller to monitor and control the pressurization of the bladder assemblies.

11. The apparatus of claim 9 wherein the means for pressurizing the fluid includes a hydraulic pump and a hydraulic fluid.

12. The apparatus of claim 11 wherein the hydraulic fluid is a hydraulic oil.

13. The apparatus of claim 11 wherein the hydraulic fluid is water.

14. A tube expander assembly, comprising:

a plurality of bladder assemblies, each bladder assembly including a probe assembly and an expandable bladder, each probe assembly comprising a first member and a second member, each member having an aperture axially extending the length of the member, the first member further including a body with an axially extending shaft, the shaft having a cylindrical portion fur receiving the bladder with a first means for attachment at an end opposite the body, the body further having a second means for attachment opposite the shaft threads, the second member including a first end and a second end, the first end including a third means for attachment to mate with the first means for attachment of the first member in order to secure the first member and second member together, the bladder being mounted over the first end of the second member and the cylindrical portion of the shall on the first end, the second end further including a fourth means of attachment, wherein the probe assembly includes a substantially radially extending aperture in fluid communication with one of the axial apertures through the first and second members;

a first connection tube of preselected length having a first end and a second end and means for attaching at the second end for removably attaching the first connection tube to one of the members of the probe assembly, the connection rube further including an axially extending aperture;

means for fluidly sealing the means for attaching the connection tubes to the bladder assemblies;

wherein the axially extending apertures of the connection tubes are in fluid communication with the apertures in the bladder assemblies when assembled to bladder assemblies to form a tube expander assembly spindle;

a means for sealing the apertures located at an opposite end of the tube expander from the first connection tube;

a means for locating the lube expander assembly within a tube relative to a datum so that each bladder in the plurality of bladder assemblies is located at a preselected position along the tube; and a means for pressurizing the tubes expander assembly spindle, the means for pressurizing in fluid communication with the apertures in the bladder assemblies and the connection tubes.

15. The tube expander assembly of claim 14 wherein the datum is a reference feature of a chiller.

16. The tube expander assembly of claim 15 wherein the reference feature of the chiller her is a tube sheet within the chiller.

17. The tube expander assembly of claim 15 wherein the preselected position of each bladder in the plurality of bladder assemblies along the tube is adjacent to a tube support so that application of pressure by the means for pressurizing the fluid causes each bladder to expand against the tube and to deform against the tube support.

18. The lube expander assembly of claim 17 hunker includes the preselected position of the bladder in a bladder assembly at an end of the tube expander assembly is adjacent a tube sheet.

19. The tube expander assembly of claim 16 wherein the means for locating the tube expander assembly within a tube includes a hard stop associated with the first connection tube.

20. The tube expander assembly of claim 19 wherein the hard stop is integral with the first connection tube.

21. The tube expander assembly of claim 19 wherein the hard stop is attached to the first connection tube.

22. The tube expander assembly of claim 19 wherein the hard stop includes a means to adjust the axial length of the first connection adjusting the length of the tube expander assembly.

23. The hard stop of claim 22 further including a counterbore to accept a tube protruding from the tube sheet, so that the hard stop can contact the tube sheet.

24. A method for expanding a tube in a chiller against a plurality of tube supports comprising the steps of:

assembling a tube into a chiller by inserting the tube through at least one tube sheet and a plurality of tube supports;

providing a tube expander assembly, the tube expander assembly comprising a plurality of bladder assemblies (14, 16, 18), each bladder assembly having an axial first end (76) and an axial second end (78), each end having a means for attachment (96), and an expandable bladder (71) positioned between the first end and the second end in fluid communication with the first end and second end;

a first, connection tube (12) of preselected length having a first end (48) and a second end (78), each end having a means for attachment (96), and an expandable bladder (71) positioned between the first end and the second end in fluid communication with the first end and second end;

a first connection tube (12) of preselected length having a first end (48) and a second end (68), with a means for locating the first connector tube (30) relative to a datum mounted to the first end, and means for attachment (70) at the second end (68) for removably attaching the first connection tube (12) to an axial end of one of the bladder assemblies (14), the connection tube (12) further including an axially extending aperture (62) in fluid communication with the bladder assembly (14);

a plurality of additional connection tubes (22) or preselected length, each tube having two axially-opposed ends, with a means for connection (26) at each end for attaching one end of the connection tube to an axial end of one of the bladder assemblies of the plurality of bladder assemblies and the remaining end to an axial end of another of the bladder assemblies of the plurality of bladder assemblies, each of the plurality of the connection tubes further including an axially extending aperture (62) to provide fluid communication between the attached bladder assemblies; and a means for fluidly sealing (36) a second end of the last bladder (18) of the plurality of bladder assemblies;

assembling the tube expander assembly into the tube so that each bladder in the plurality of bladder assemblies is positioned within the tube adjacent one tube support of the plurality of tube supports, each bladder corresponding to each tube support;

applying pressure to the tube expander assembly so that each bladder in the plurality of bladder assemblies simultaneously expands against the tube with sufficient pressure to plastically deform the tube against the tube supports;

holding the pressure for a preselected period of time; and then releasing the pressure.

* * * * *